US005515097A

United States Patent [19]

Munechika et al.

[11] Patent Number: 5,515,097

[45] Date of Patent: May 7, 1996

[54] APPARATUS WITH BEAM SHIFTING ASSEMBLY MEANS CONTROLLED TO INCREASE RECORDING RESOLUTION

[75] Inventors: Stacy M. Munechika, Rochester; Yee S. Ng, Fairport; Jose M. Mir, Rochester, all of N.Y.

[73] Assignee: Eastman Kodak Company, Rochester, N.Y.

[21] Appl. No.: 44,432

[22] Filed: Apr. 5, 1993

[51] Int. Cl.[6] ..... B41J 2/47; B41J 2/45

[52] U.S. Cl. ..... 347/241; 347/238; 347/239; 347/134

[58] Field of Search ..... 346/107 R; 347/238, 347/239, 241, 243, 130, 134, 255, 256, 260; 359/247, 302

[56] References Cited

U.S. PATENT DOCUMENTS

| | | | |
|---|---|---|---|
| 3,279,341 | 10/1966 | Arkell et al. | 346/107 R |
| 4,090,206 | 5/1978 | Pfeifer et al. | 346/107 R |
| 4,198,158 | 4/1980 | Knowlton . | |
| 4,437,106 | 3/1984 | Sprague . | |
| 4,602,262 | 7/1986 | Milligan et al. | 346/160 |
| 4,743,927 | 5/1988 | Sasaki | 346/160 |
| 4,750,010 | 6/1988 | Ayers et al. . | |
| 4,797,694 | 1/1989 | Agostinelli et al. . | |
| 4,801,194 | 1/1989 | Agostinelli et al. . | |
| 4,835,551 | 5/1989 | Ng . | |
| 4,885,597 | 12/1989 | Tschang et al. . | |
| 4,900,130 | 2/1990 | Haas . | |
| 4,920,355 | 4/1990 | Katerberg . | |
| 4,940,314 | 7/1990 | Hecht | 346/160 |
| 5,054,893 | 10/1991 | Schoon | 359/254 |
| 5,113,202 | 5/1992 | Loce et al. . | |
| 5,166,999 | 11/1992 | Rees et al. . | |
| 5,191,358 | 3/1993 | Iwasaki | 346/107 R |

OTHER PUBLICATIONS

Digital Light Deflectors, by Kulcke et al Applied Optics, vol. 5, No. 10, Oct. 1966, pp. 1657–1667.

*Primary Examiner*—Benjamin R. Fuller
*Assistant Examiner*—David Yockey
*Attorney, Agent, or Firm*—Norman Rushefsky

[57] ABSTRACT

An electrophotographic recording apparatus and method wherein an electrophotographic recording medium is continuously moved in a first direction relative to a row of light-emitting recording elements such as LEDs. A beam shifter assembly is located within an optical path between the LEDs and the recording medium. The beam shifter assembly is operable in a first mode to pass light from the LEDs without substantial lateral shifting and in a second mode to pass light with substantial shifting of said light in a lateral direction having a directional component parallel to the row of LEDs. A control is provided for controlling the beam shifter assembly in different modes on alternate recording time lines of exposure. This helps minimize in-track artifacts. The apparatus is also operable in a multiaddress mode that is automatically instituted when a higher resolution image scanner is used or when a higher resolution character font library is input for recording.

9 Claims, 7 Drawing Sheets

APPARATUS WITH BEAM SHIFTING ASSEMBLY MEANS CONTROLLED TO INCREASE RECORDING RESOLUTION

BACKGROUND OF THE INVENTION

1. Field of the Invention

The invention pertains generally to non-impact recording and more particularly to recording on electrophotographic recording media.

2. Brief Description of the Prior Art

In U.S. Pat. No. 4,885,597, there is described non-impact printing on electrostatographic recording medium. The non-impact printing described therein uses light-emitting diode (LED) printheads to record by modulating charge on an electrophotoconductive medium.

Light-emitting diode (LED) printheads typically consist of a linear array of LEDs arranged such that the pitch between LEDs is equal to the printhead resolution. The LEDs are arranged in the cross-track direction with respect to the path of movement of the photosensitive recording medium which enables an entire line of data to be exposed in parallel. If subsequent lines of printing-exposure data are activated at subpitch intervals, then the apparent resolution of the printhead is increased in the in-track direction (i.e., the direction orthogonal to the LED array and in-line with the path of movement). This technique is called multiple-address recording. Multiple-address printing increases the addressability of the printhead which provides a higher density of dots per inch. Currently, multiple-address recording is limited to the in-track direction only. The only way to increase the address,ability of the printhead in the cross-track direction is to increase the resolution by increasing the number of the LEDs per unit length. Increasing the number of LEDs will increase the burden of the driving electronics. In addition, increasing the number of LEDs exacerbates the problem of array and tile butting (alignment) errors. The LEDs are formed on chip arrays of say 128 LEDs in each array. The plural arrays are then assembled into a row of arrays to form a single row of several thousand LEDs. Where the LEDs are made closer together on each array, the butting of adjacent arrays becomes more difficult in attempting to maintain a uniformity of pitch distance between LEDs at the ends of adjacent arrays. Groups of LEDs may be assembled onto tile modules and the same difficulty obtains in spacing of LEDs at the ends of the modules when the modules are assembled onto printheads.

It is therefore an object of the invention to provide an improved method and apparatus for multiple address recording that increases cross-track image resolution without increasing in the number of recording elements.

It is another object of the invention to provide an improved method and apparatus for recording pixels that may be used to minimize artifacts resulting from nonuniformities such as in the positioning of the recording elements.

SUMMARY OF THE INVENTION

These and other objects and advantages of the invention are realized by a method and apparatus for recording wherein an electrophotographic recording method and apparatus are provided, the method comprising the steps of moving an electrophotographic recording medium in a first direction relative to a row of light-emitting recording elements, the recording medium having an electrostatic charge;

energizing a plurality of light-emitting recording elements to imagewise modulate charge on said recording medium; and operating a beam shifter assembly located within an optical path between said recording medium and said recording elements, said step of operating including operation in a first mode wherein light from selected recording elements pass through said assembly without substantial lateral shift and in a second mode wherein light passes through said assembly with substantial shifting of light in at least a lateral direction having a directional component parallel to the row of recording elements and wherein said beam shifter assembly is operated in said first and second modes on alternate recording time lines of exposure.

In accordance with another aspect of the invention, there is provided a method of recording images, comprising moving a light-sensitive recording medium in a first direction relative to a row of light-emitting recording elements; simultaneously energizing a plurality of said light-emitting recording elements to record on said medium, during a first pixel line recording period, a row of pixels in a direction transverse to said first direction; generating a signal relative to a recording resolution in said transverse direction of an image to be recorded; and in response to said signal energizing said plurality of recording elements during another pixel line recording period and shifting light beams from said recording elements to position pixels recorded during said another line recording period to form pixels in said row of pixels on areas of said medium that are between pixels recorded by said first pixel line period.

In accordance with still another aspect of the invention, there is provided a method of recording images, comprising moving a light-sensitive recording medium in a first direction relative to a row of light-emitting recording elements that are spaced at approximately N recording elements per inch; simultaneously energizing a plurality of said said light-emitting recording elements to record on said medium, during a first pixel line recording period, a row of pixels in a second direction transverse to said first direction; and energizing said plurality of recording elements during another pixel line recording period and shifting light beams from said recording elements to position pixels recorded during said another line recording period to form pixels in a second row of pixels on areas of said medium with pixels shifted laterally, in the direction of said row of light emitting elements to reduce artifacts in an image caused by nonuniformities in said recording elements.

DETAILED DESCRIPTION OF THE PREFERRED EMBODIMENTS

The apparatus and method of the preferred embodiments will be described in accordance with an electrophotographic recording medium employing LED's as an exposure source. The invention, however, is not limited to apparatus for creating images on such a medium or with such exposure devices as other media such as photographic film, etc. may also be used with the invention as well as other devices for providing image creation in accordance with the teachings of the invention.

Because electrophotographic reproduction apparatus are well known, the present description will be directed in particular to elements forming part of or cooperating more directly with the present invention. Apparatus not specifically shown or described herein are selectable from those known in the prior art.

Figure 1:
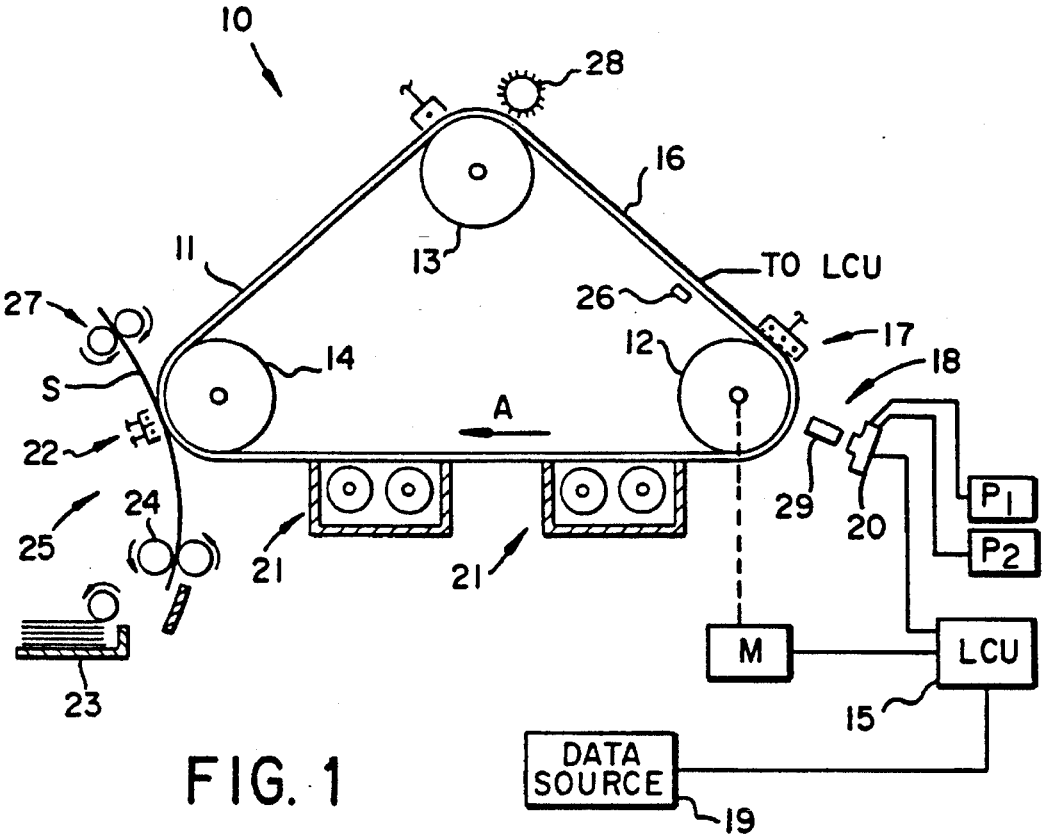
FIG. 1 PRIOR ART
FIG. 1 is a schematic of a printer apparatus that is in accordance with the prior art.

With reference now to FIG. 1, an electrophotographic reproduction apparatus 10 includes a recording medium such as a photoconductive web 11 or other radiation-sensitive medium that is trained about three transport rollers 12, 13 and 14, thereby forming an endless or continuous web. Roller 12 is coupled to a drive motor M in a conventional manner. Motor M is connected to a source of potential when a switch (not shown) is closed by a logic and control unit (LCU) 15. When the switch is closed, the roller 12 is driven by the motor M and moves the web 11 in clockwise direction as indicated by arrow A. This movement causes successive image area of the web 11 to sequentially pass a series of electrophotographic work stations of the reproduction apparatus. In lieu of a web, a drum photoconductor may be used.

For the purposes of the instant disclosure, several work stations are shown along the web's path. These stations will be briefly described.

First, a charging station 17 is provided at which the photoconductive surface 16 of the web 11 is sensitized by applying to such surface a uniform electrostatic primary charge of a predetermined voltage. The output of the charger may be controlled by a grid connected to a programmable power supply (not shown). The supply is in turn controlled by the LCU 15 to adjust the voltage level Vo applied onto the surface 16 by the charger 17.

At an exposure station 18 an electrostatic image is formed by modulating the primary charge on an image area of the surface 16 with selective energization of point-like radiation sources in accordance with signals provided by a data source 19. The point-like radiation sources are supported in a print head 20 to be described in more detail below.

A development station 21 includes developer which may consist of iron carrier particles and electroscopic toner particles with an electrostatic charge opposite to that of the latent electrostatic image. Developer is brushed over the photoconductive surface 16 of the web 11 and toner particles adhere to the latent electrostatic image to form a visible toner particle, transferable image. The development station may be of the magnetic brush type with one or two rollers. Alternatively, the toner particles may have a charge of the same polarity as that of the latent electrostatic image and develop the image in accordance with known reversal development techniques. More than one developer station 21 may be provided for developing images in plural colors.

The apparatus 10 also includes a transfer station 25 shown with a corona charger 22 at which the toner image on web 11 is transferred to a copy sheet S; and a cleaning station 28, at which the photoconductive surface 16 of the web 11 is cleaned of any residual toner particles remaining after the toner images have been transferred. After the transfer of the unfixed toner images to a copy sheet S, such sheet is transported to a heated pressure roller fuser 27 where the image is fixed to the copy sheet S.

As shown in FIG. 1, a copy sheet S is fed from a supply 23 to driver rollers 24, which then urge the sheet to move forward onto the web 11 in alignment with a toner image at the transfer station 25.

To coordinate operation of the various work stations 17, 18, 21, and 25 with movement of the image areas on the web 11 past these stations, the web has a plurality of indicia such as perforations along one of its edges. These perforations generally are spaced equidistantly along the edge of the web 11. At a fixed location along the path of web movement, there is provided suitable means 26 for sensing web perforations. This sensing produces input signals into the LCU 15 which has a digital computer, preferably a microprocessor. The microprocessor has a stored program responsive to the input signals for sequentially actuating, then de-actuating the work stations as well as for controlling the operation of many other machine functions. Additional encoding means may be provided as known in the art for providing more precise timing signals for control of the various functions of the apparatus 10.

Programming of a number of commercially available microprocessors is a conventional skill well understood in the art. This disclosure is written to enable a programmer having ordinary skill in the art to produce an appropriate control program for the one or more microprocessors used in this apparatus. The particular details of any such program would, of course, depend on the architecture of the designated microprocessor.

Figure 2:
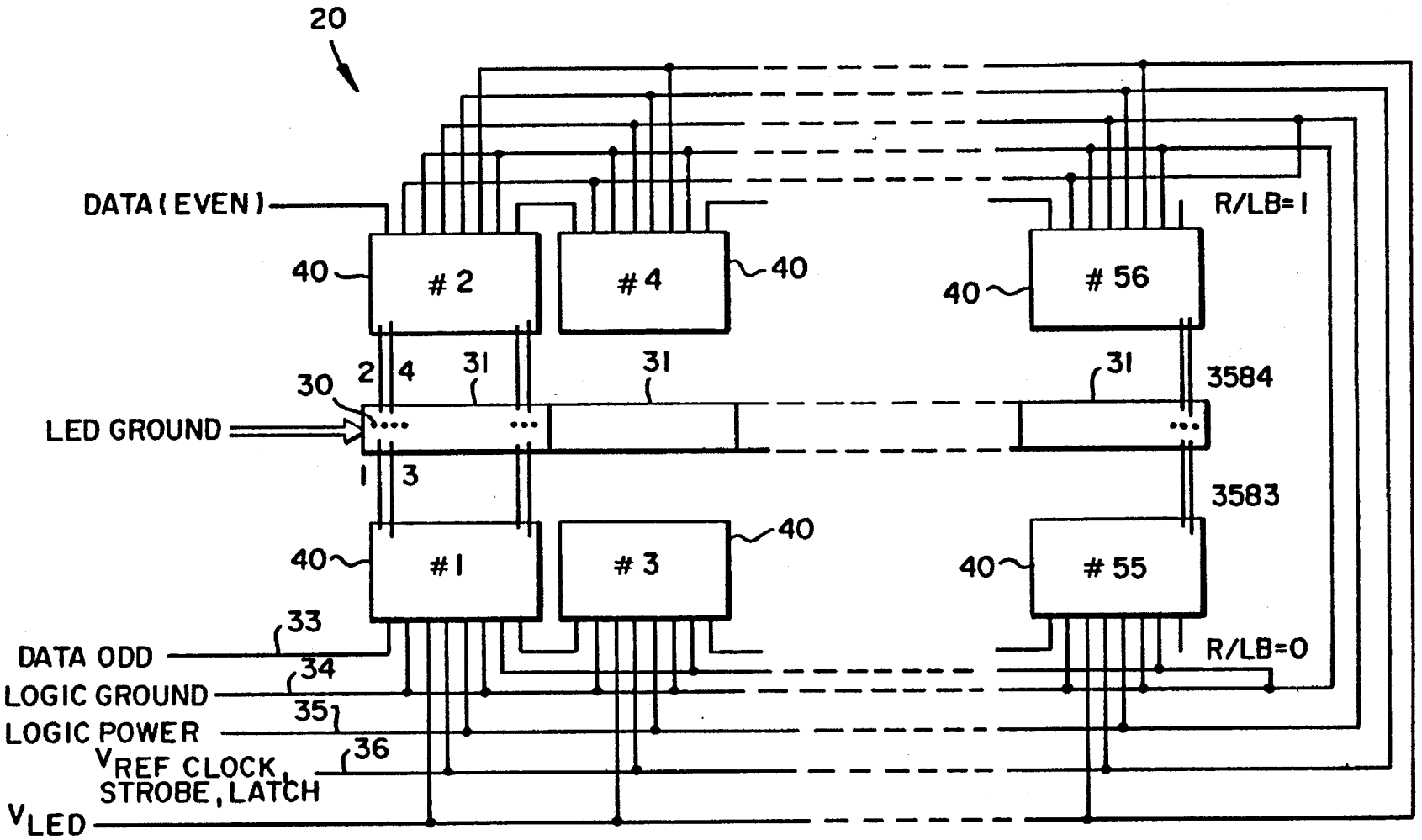
FIG. 2 PRIOR ART
FIG. 2 is a block diagram in schematic of elements on a printhead of the prior art that are part of the printer apparatus.

With reference to FIGS. 1 and 2, the print head 20, as noted, is provided with a multiplicity of energizable point-like radiation sources 30, preferably light-emitting diodes (LEDs). Optical means 29 may be provided for focusing light from each of the LEDs onto the photoconductive surface. The optical means may include a lens and preferably comprises an array of optical fibers such as sold under the name Selfoc, a trademark for a gradient index lens array sold by Nippon Sheet Glass, Limited. Due to the focusing power of the optical means 29, a row of emitters will be imaged on a respective transverse line on the recording medium.

With reference also to FIG. 2, the print head 20 comprises a suitable support with a series of LED chips or arrays 31 mounted thereon. Each of the chips 31 includes in this example 128 LEDs arranged in a single row. Chips 31 are also arranged end-to-end in a row and where twenty-eight LED chips are so arranged, the print head will extend across the width of the web 11 and include 3584 LEDs arranged in a single row. To each side of this row of LEDs there are provided twenty-eight identical driver chips 40. Each of these driver chips include circuitry for addressing the logic associated with each of 64 LED's to control whether or not the particular LED should be energized as well as to determine the level of current to each of the LED's controlled by that driver chip 40. Two driver chips 40 are thus associated with each chip of 128 LEDs. Each of the two driver chips will be coupled for driving of alternate LEDs. Thus, one driver chip will drive the odd numbered LEDs of the 128 LEDs and the other will drive the even numbered LEDs of these 128 LEDs. The driver chips 40 are electrically connected in parallel to a plurality of lines 34–37 providing various electrical control signals. These lines provide electrical energy for operating the various logic devices and current drivers in accordance with their voltage requirements. A series of lines 36 (indicated by a single line in this FIG.) provide clock signals and other pulses for controlling the movement of data to the LEDs in accordance with known techniques. A data line 33 is also provided for providing data signals in the form of either a high or low logic level. The driver chips each include a data in and data out port so that they serially pass data between them.

Figure 3:
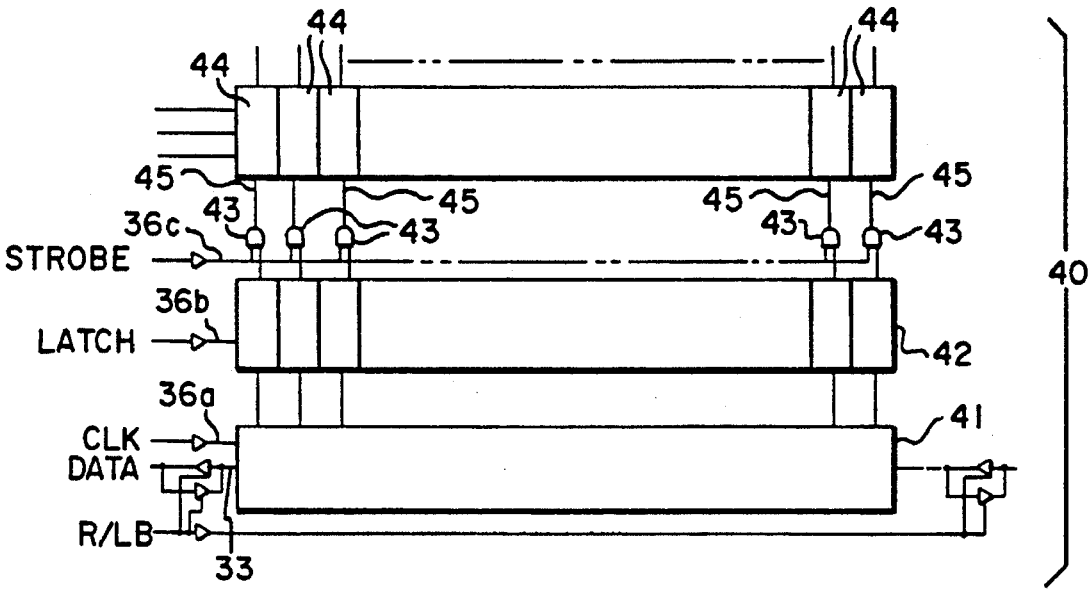
FIG. 3 PRIOR ART
FIG. 3 is a block diagram of a prior art driver circuit for use in the printhead of FIG. 2.

With reference now to FIG. 3, the architecture for each driver chip 40 includes a 64 bit bidirectional shift register 41. A logic signal carried over line R/LB determines the direction data will flow down this register. Assume that this chip is enabled to cause data to flow down the register from left to right as shown in FIG. 3. Data thus enters shift register 41 over line 33 through the driver chip's data-in port at the left from say the data-out port of a driver chip immediately to the left or from the LCU if the driver chip 40 is the first chip for data to enter. Data exits from this chip at the data-out port to be input to the next adjacent driver chip to the fight of driver chip 40. For each line of image to be exposed in the main scanning direction, i.e., transverse to that of movement of the recording medium or web 11, data from the data source suitably rasterized, in accordance with known techniques, streams serially through the shift registers under control of clock pulses provided by the LCU over line 36*a*. As may be noted, odd and even data may be moved simultaneously since they are provided on separate lines. Still further reductions in clock speed for moving data through the shift registers may be provided by providing additional lines for distributing data simultaneously. Thus, one line of data may be dedicated to even-numbered LEDs of low number, i.e., those driven by driver chips numbered 2 through 28, a second line dedicated to even-numbered LEDs of high number, i.e., those driven by driver chips numbered 30–56, and an additional two lines for similarly simultaneously driving odd-numbered LEDs of low and high numbers, respectively. When 3584 bits of data (1's or 0's) are stored by the shift registers of all of the driver chips, a latch signal is provided over line 36*b* to latch this data into latch registers 42 so that the shift registers 41 may commence filling with data signals for the next line of exposure. Sixty-four latch registers 42 are provided in each driver chip to receive the data shifted out in parallel fashion from the shift register 41. Each latch register is associated with a particular LED and adjacent latch registers are associated with every other LED. A logic AND gate 43 is associated with each latch register and has one input coupled to the output of its respective latch register and its other input coupled to a line 36*c* for providing a strobe or timing pulse from the LCU. This strobe pulse determines when to trigger the LEDs to turn on in relation to the position of the recording medium and the duration for which the LEDs are turned on. All the AND gates have one of their inputs connected to this strobe line. Alternatively, a plurality of strobe lines may be provided with enabling times of different durations; see in this regard U.S. Pat. No. 4,750,010 to Ayers et al, the contents of which are incorporated herein by this reference. The output of each of the AND gates 43 is coupled to a logic circuit that is part of a constant current driver circuit 44 which in turn outputs a current to drive an LED with a controlled level of current for a period of time determined by the strobe pulse. The above details represent a conventional LED printhead and are not essential to utilization of the invention.

The inventors have discovered that what is currently lacking is the ability to displace or shift the writing spot (the image of the LED or a focussed spot) a lateral distance in the cross-track direction such as, for example, approximately one half of the LED pitch spacing. If this could be accomplished, then the LED printhead would have dual-resolution recording in the cross-track direction with high speed recording. For example and with reference to FIG. 4, a printhead with a resolution of 300 LEDs per inch could provide writing spots at twice the LED pitch in the cross-track direction yielding a 600 DPI addressable printhead — without increasing the number of LEDs. As a side benefit, the cross-track addressability could be used to compensate for butting errors referred to above by placing writing spots in blank regions where the tile or array gap is too large.

While it is conceivable that the LED writing spots could be shifted by mechanically moving the printhead or film plane (e.g. with a piezoelectric element) the limited rate of the mechanical movement will severely limit the throughput speed of the system. In addition, the induced vibrations can create registration problems as well as reduce the overall system reliability.

In accordance with the invention, as will be described in the embodiments herein, an electro-optical lateral image shifter is inserted between the array of LEDs and the SELFOC lens. The light emitted from an LED enters the image shifter and is then shifted laterally in response to an applied electric field to the image shifter. The division of exposure energy between the original and shifted LED locations can be controlled by adjusting the magnitude of the applied voltage to the image shifter. Thus, the exposure energy can be dedicated completely to the original position or the shifted position, or it can divided arbitrarily between the two positions. In the embodiments described specifically herein, the exposure energy is dedicated completely to the original position or the shifted position; however, in its broader aspects the invention is not so limited.

The printhead can operate either in a conventional mode (i.e. no electric field applied to the image shifter) or in the enhanced mode wherein the image shifter is activated on alternate lines of exposure. That is, the LED writing spots are displaced for every other line of exposure data sent to the printhead. In addition, a stair-step or ramp-like voltage waveform can be applied to the image shifter to alter the shape of the exposure distribution of the LED spot(s) on the image plane. The SELFOC lens array images the LED spots at the exit face of the image shifter and is used to increase the working distance to the image plane. A description of a preferred embodiment of the invention will now be made with reference to FIGS. 4–7.

Figure 6:
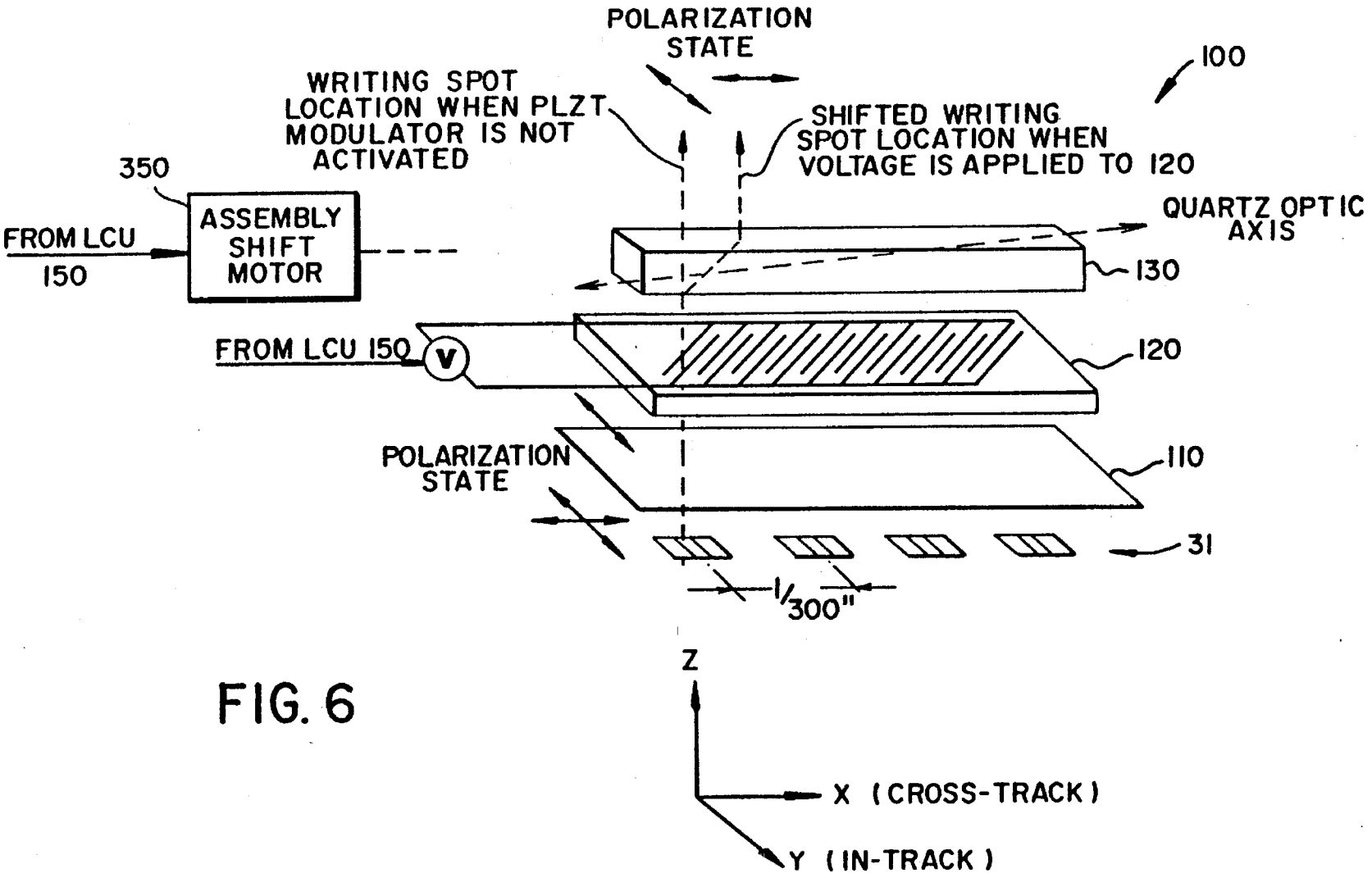
FIG. 6 is a schematic in perspective of a portion of the printer apparatus of FIG. 5.

Discrete lateral image shifters have been previously fabricated for use with coherent laser beams. With reference to FIG. 6. A typical configuration of a lateral image shifter comprises a linear polarizer, an electro-optic (E-O) modulator (e.g. KDP crystal) 120 and a birefringent material such as calcite. For example, see Kulcke et al, "Digital Light Deflectors," Applied Optics, Volume 5, 1966, pages 1657–1667. The image shifter used in this invention utilizes Lanthanum modified Lead Zirconate Titanate (PLZT) material as the E-O modulator and polished quartz as the birefringent material (130). For the sake of clarity, the components in FIG. 6 are depicted to be separated. In actual practice, the components are bonded together. FIG. 6 also features a diagram showing the coordinate system used to describe the orientation of the individual image shifter components.

Referring to FIG. 6, all components are oriented parallel to the X and Y plane. The linear polarizer (110) is oriented such that the exiting light is polarized in the Y-direction (perpendicular to the row of LEDs). The interdigital electrodes on the PLZT modulator are at 45 degrees to the Y-axis in the X and Y plane and hence, the electric field applied to the interdigital electrodes on the PLZT material is oriented at 45 degrees to the entering linearly polarized light. The birefringent quartz strip (130) is cut with its optic (crystalline) axis at 45 degrees to the top and bottom surface in the X and Z plane. In this configuration, the linearly polarized light in the Y-direction corresponds to the ordinary ray and passes straight through the quartz strip (130) undeviated. When an electric field equal to the halfwave voltage of the PLZT modulated is applied, the linearly polarized light is rotated 90 degrees around the Z-axis as it exits from the PLZT modulator. The exiting light now corresponds to the extraordinary ray which is diverted as it passes through the birefringent quartz. By modulating the voltage to the PLZT modulator, the LED writing spot on the image plane can be shifted between the two positions.

Figure 4:
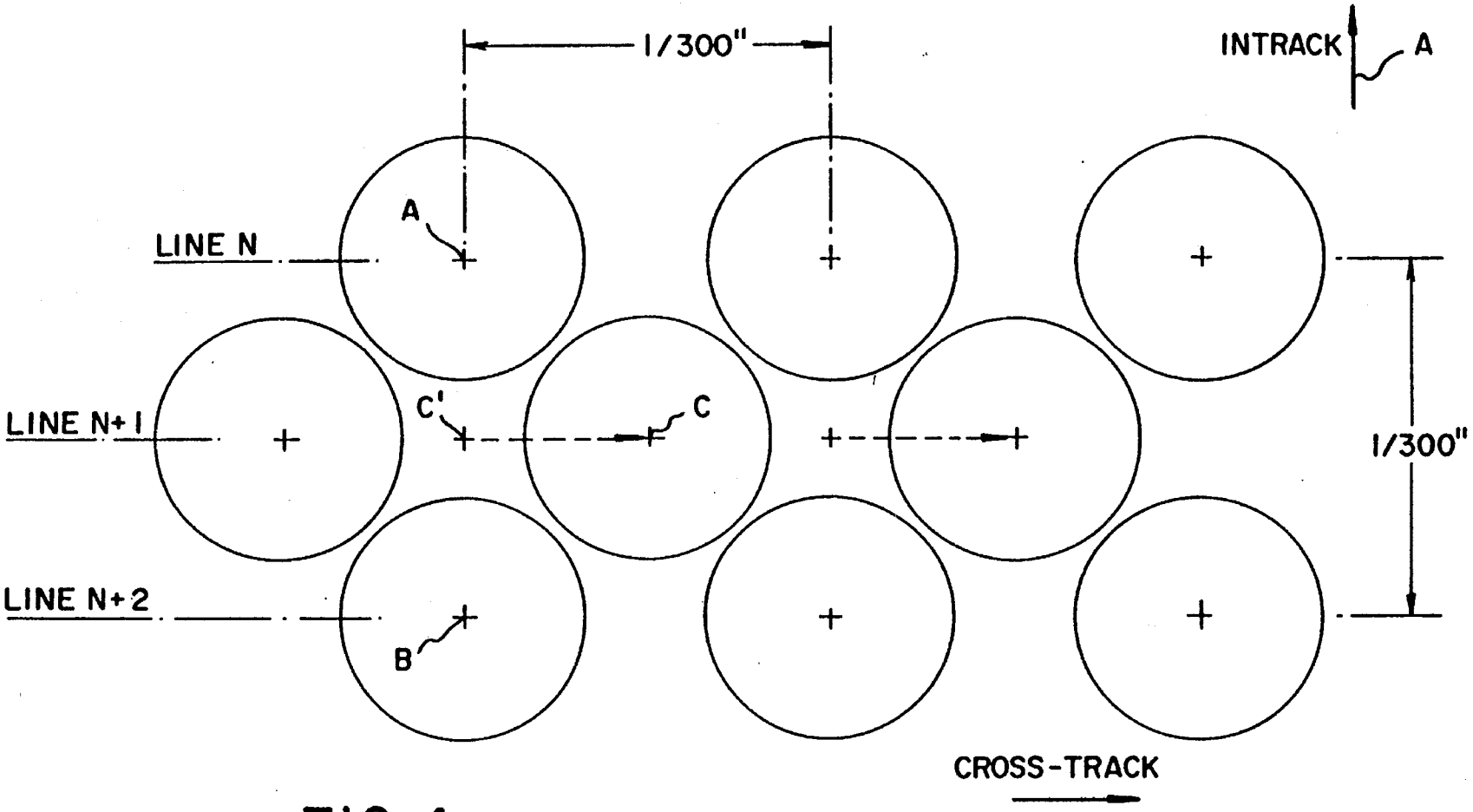
FIG. 4 is a diagram in schematic of latent image recording dot areas as formed in accordance with use of one embodiment of the method and apparatus of the invention and featuring improved cross-track resolution.

With reference to FIG. 4, latent electrostatic image recorded dots or pixels are illustrated. These dots are recorded on the photoconductive web that is moving continuously in the in-track or sub-scanning direction as indicated by arrow A. The printhead is a 300 dots per inch (dpi) printhead; i.e., a uniform pitch of 300 LED units per inch at least to the LEDs in each chip or array. The spacing between the adjacent LEDs at the ends of butting arrays may not be this uniform spacing because of errors in assembly. In such instances when a recorded image is developed, streaks in the in-track direction may be noted when reproducing pictorial images containing a sky or other non-busy or flat type of field. As shown in FIG. 4, line N of recorded pixels shows three pixels recorded at a spacing of 1/300 inches in the cross-track or main scan direction. The printhead, when operating as a conventional printhead, will print at a 300 × 300 dots per inch$^2$ resolution. Thus, the normal next line to be printed would be line N+2. In aforementioned U.S. Pat. No. 4,835,551, a printhead is described wherein additional pixels are provided in the in-track direction and thus additional recording lines are provided between lines N and N+2. In the example of FIG. 4, the LED X that records pixels having centers A and B, records pixel C at the time for recording pixel recording line N+1 which is midway between recording lines N and N+2. A pixel having a center C has its recording beam shifted in the cross-track direction to record this pixel C. Thus, in a normal multiple resolution recording mode, this pixel would be recorded at center C' which is in-line with pixels A and B. In the improved printhead of the invention, the pixel having center C is recorded by LED X so as to be offset in the cross-track direction.

As discussed above, an advantage for shifting alternate lines of pixels one-half a pixel spacing in the cross-track direction is to reduce the visibility of line streaks caused by butting errors in LED array assembly or in uniformity of the LEDs. Such a benefit would obtain even were the printheads to operate in its 300 × 300 dots per inch$^2$ alternative mode instead of the 300 × 300 dots per inch$^2$ higher resolution mode illustrated in FIG. 4.

Figure 7:
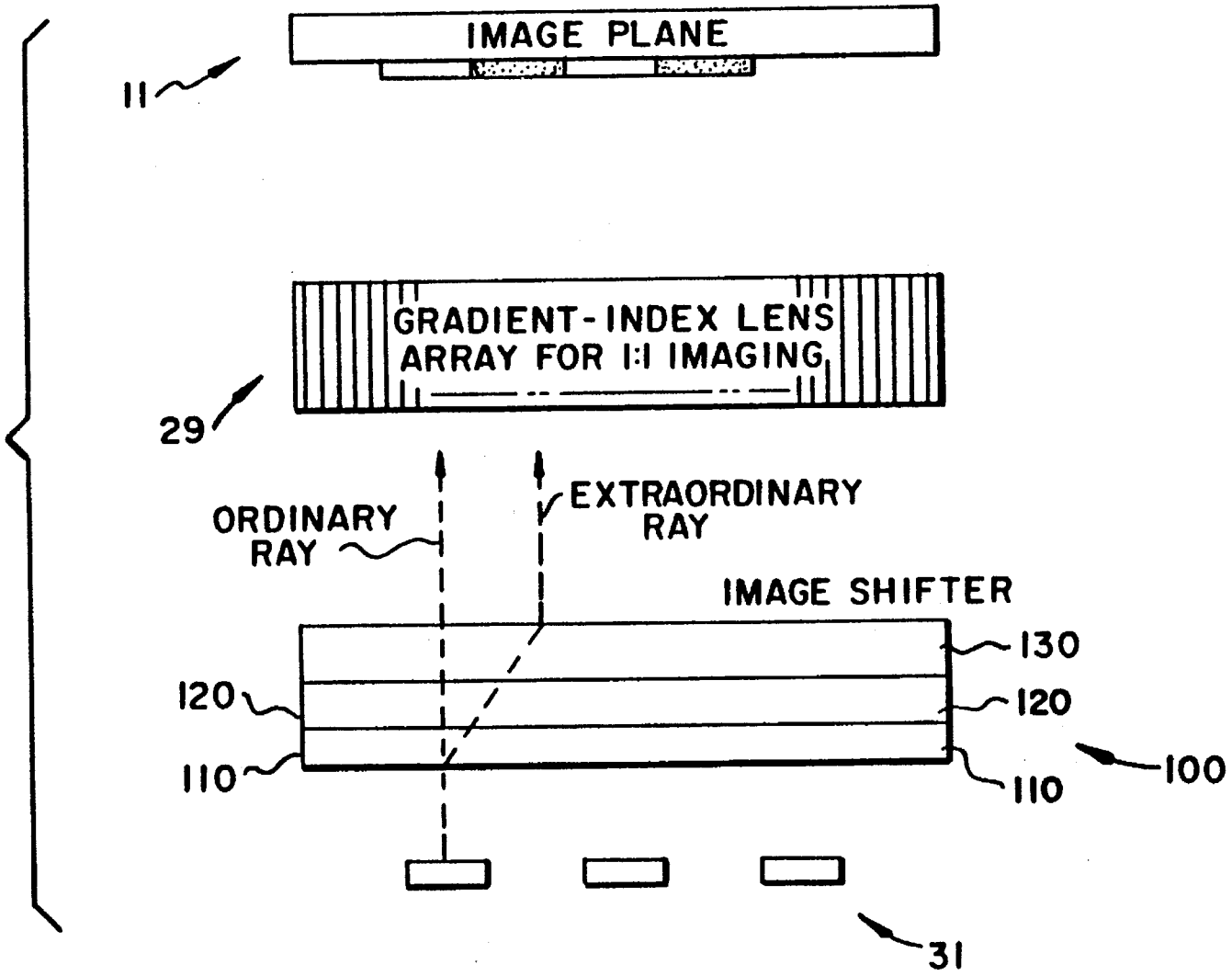
FIG. 7 is a side view in schematic of a portion of the printer apparatus of FIG. 5.

The signal processing circuitry for generating data to the printhead of the type shown in FIGS. 2 and 3, but that includes the modifications illustrated in FIGS. 6 and 7 will now be described with reference to FIG. 5. This signal processing is relatively conventional but includes provision for generating a beam-shifting signal and the ability to have selection of different copying resolutions without the need for multiplying data to a higher resolution than that scanned in by a lower resolution scanning device.

Figure 5:
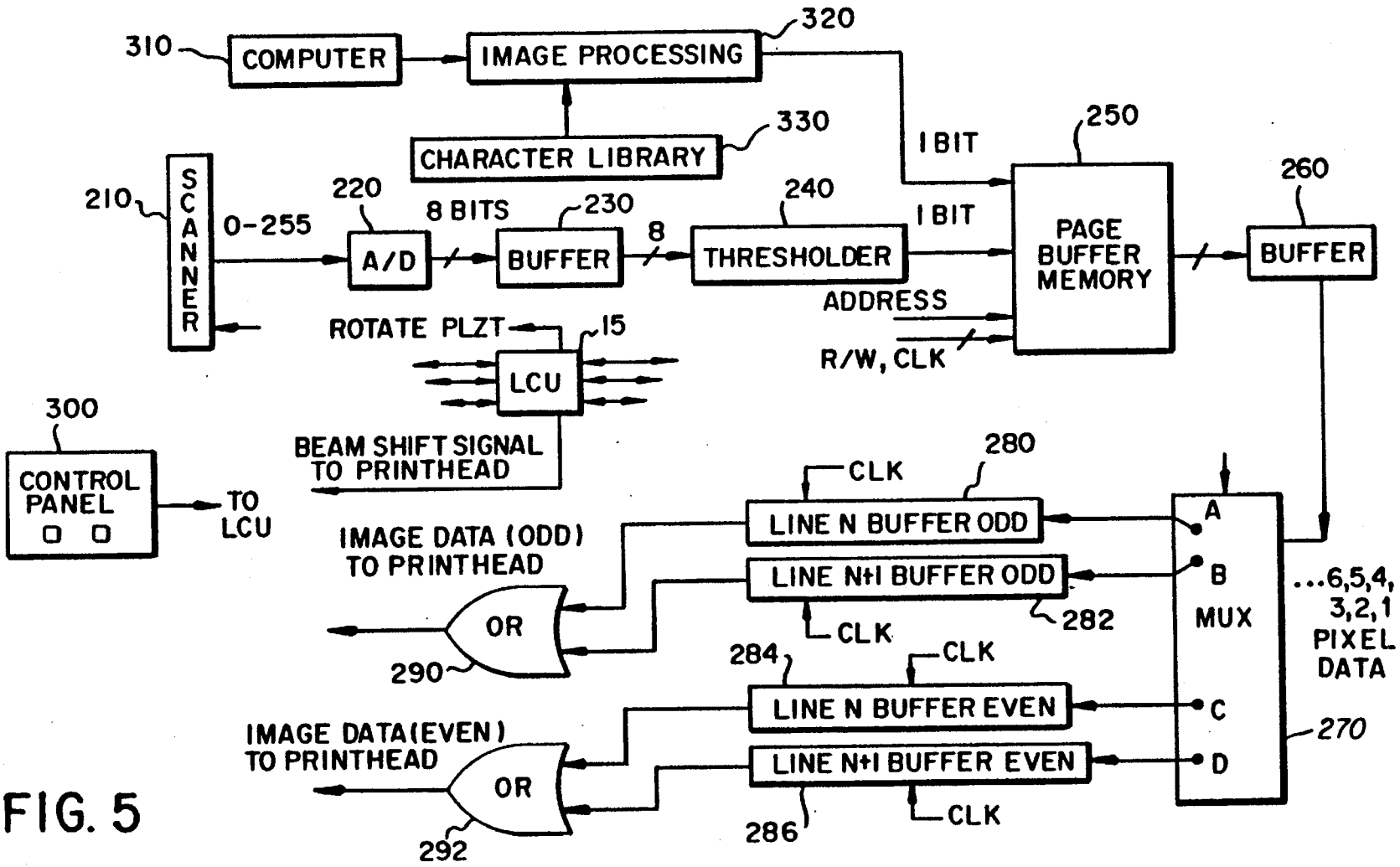
FIG. 5 is a block diagram of one embodiment of a signal process circuit forming a part of the printer apparatus of the invention.

With reference now to FIG. 5, a copier includes a document scanner 210 that scans an original document supported on a platen or drum. The scanner 210 in this embodiment may be a linear array that includes 300 scanning elements per inch such as charge coupled devices (CCDs) or photodiodes. A control panel 300 is provided for the operator to indicate the various conventional copy related information such as number of copies, density, paper supply for copy sheets and other copy and finishing requirements such as duplex, stapling, collation, etc. In addition, another input is provided to select resolution; i.e., 300 × 300 dpi$^2$ or 300 × 600 dpi$^2$. The output of the scanner may be an analog signal output that indicates the density of each pixel area sensed in terms of values from say 0 to 255. This signal is digitzed into an 8-bit signal by an A/D converter 220. The scanner may be remote from the printer portion but connected by facsimile transmission.

In accordance with the invention, the scanner in response to a signal from the LCU 15 is caused to sample the document at either 300 scans per inch or 600 scans per inch (in the sub-scanning direction of travel of the document relative to the scanning array) as requested by the operator from an input at the control panel or as may be input via a code on the document sheet original. The 8-bits per pixel density signal is buffered in a buffer 230 and then subjected to a known threshold circuit 240 for converting the 8-bits per pixel signal to a one-bit per pixel binary data signal. The binary image data signals may be stored in a page buffer memory 250. When the printer is ready to print, the image data is removed from the page buffer memory and either input to a buffer 260 from which data bits are serially output to a multiplexer 270 or other suitable switching device. Alternatively, buffer 260 may be eliminated. In this example, the scanner and printer are both nominally 300 dpi apparatus in their respective cross-track directions so the 3584 binary bits of data for line N merely needs to be divided into odd and even buffers 280, 284. This is done to feed data to the odd and even driver chips that are located on opposite sides of the row of LEDs. Additional odd and even buffers 282, 286 may be provided for the following line N+1 so that as data is being clocked out to the printhead 20 via OR logic 3 gates 290, 292 from buffers for line N, data for the next succeeding line are input to buffers 282, 286 for line N+1. Since operation in a 300 × 300 mode is conventional, the operation in a 300 × 600 mode will be described. The data for line N is shifted out to the printhead 20 to registers 41 and then latches 42 for printing in the conventional way. In FIG. 4, the three pixels illustrated on line N are printed by three adjacent LEDs without being shifted in position. Next, data for line N+1 is loaded and sent to the printhead and latched in latches 42 (FIG. 3). A signal from the logic and control unit (LCU) 15 provides a beam shift signal in the form of a voltage signal across the PLZT modulator to cause a voltage source V to be applied across the electrodes of the PLZT modulator. In response to a strobe signal on line 36C (FIG. 3) which establishes pulse duration for recording each pixel during a pixel line recording period all beams in line N+1 are shifted laterally. Thus, the recorded pixels for recording time period line N+1 are all shifted laterally one-half pixel spacing from that of pixel recording lines N and N+2. However, the next following line, N+3, will be shifted like that of N+1. This alternating pattern of lateral shifting tends to visually lessen in-track recording streaks thereby providing for improved visual images.

The geometry of the image shifter assembly described above is for a lateral shift in the cross-track direction (X-axis); i.e., the direction of the row of LEDs. A shift at an arbitrary angle to the X-axis can be achieved by tilting the polarizer, modulator and quartz optical axis around the Z-axis. One advantage to placing the shifted LEDs at an angle slightly off center of the LED array is that two subsequent exposure lines of pixels can be superimposed. This is accomplished by ensuring that the amount of LED displacement along the in-track direction (Y-axis) is equal to the velocity of the photoconductor surface multiplied by the exposure line time.

The amount of shift or lateral displacement is dependent on the wavelength dependent birefringence and thickness of the quartz material. Since the LEDs in a printhead are nearly monochromatic, the displacement can be selected primarily as a function of the thickness of the quartz. The angle of deviation between the ordinary and extraordinary ray in quartz is approximately 0.3 degrees. Hence, in the example of a 300 dpi LED printhead with a 42 μm half-pitch length, the quartz thickness would be approximately 8 μm. In addition, the SELFOC lens standoff distance to the LEDs is increased as a result of inserting the quartz plate between the LEDs and the lens. The modified distance is also dependent on the thickness of the quartz strip.

Figure 8:
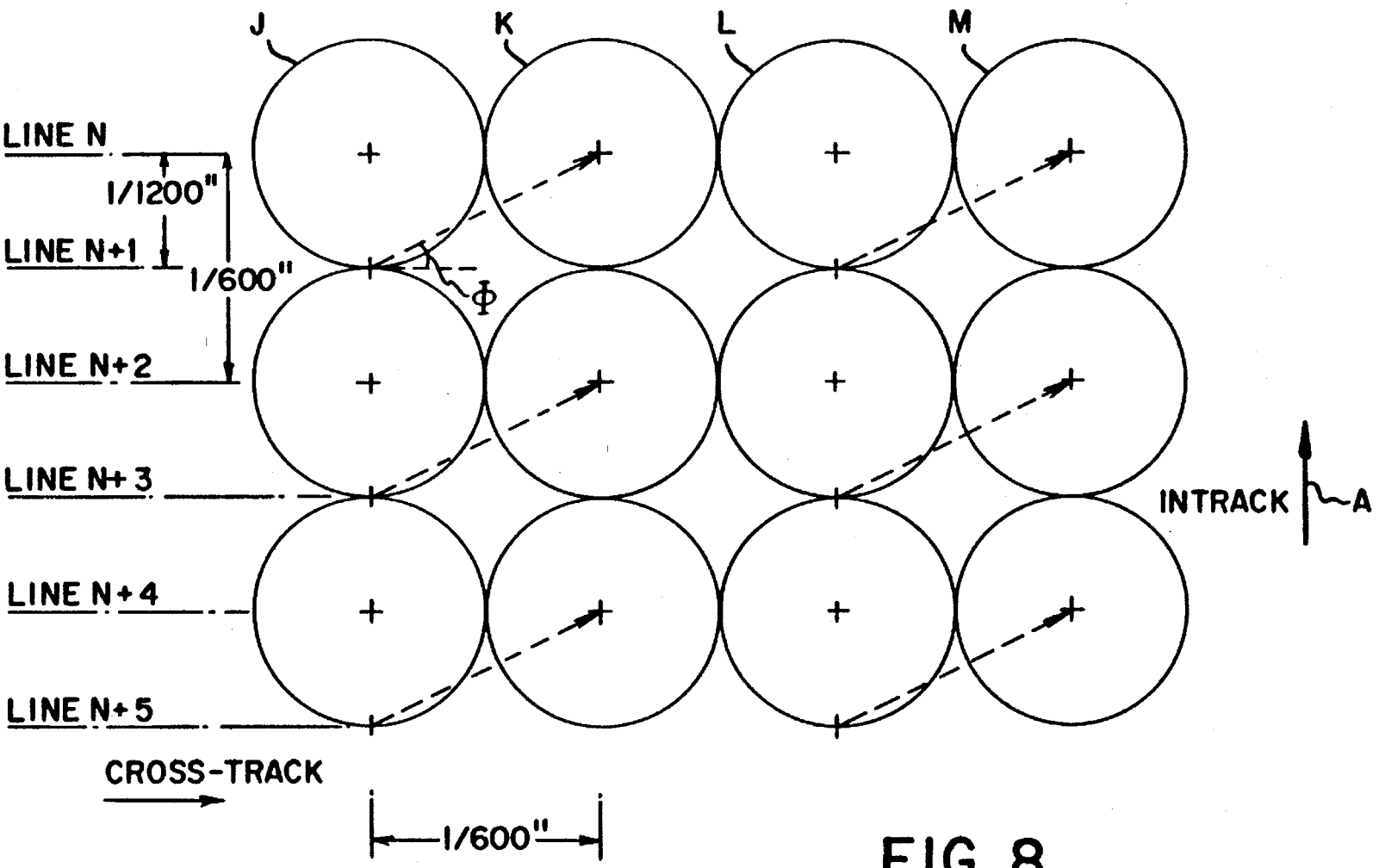
FIG. 8 is a diagram in schematic of latent image recording dot areas as formed in accordance with use of a second embodiment of the method and apparatus of the invention and featuring improved cross-track and in-track resolution recording.

An auxiliary source of data is also shown in FIG. 5 and comprises a computer 310 or disc drive for receiving a computer diskette or other recorded medium upon which data is recorded. The coded data is processed by a conventional image processor circuit 320 which has associated therewith a character font library 330 for transforming character coded data into rasterized form. The character library may be removable so that various resolution fonts may be substituted. For example, there may be used a 300 × 300 dpi$^2$ font, a 300 × 600 dpi$^2$ font and a 600 × 600 dpi$^2$ font. An example of 600 × 600 dpi$^2$ pixel resolution is illustrated in FIG. 8. It should be understood, however, that FIGS. 4 and 8 are illustrative for purposes of explaining operation of the invention and that the individual pixels may be closer together and overlap and/or be of different shape than that schematically illustrated. In order to obtain same, the image shifter assembly 100 is removed and a second similar assembly inserted which has a quartz strip of different thickness from that of the assembly 100 so that the amount of shift is greater. In addition, this assembly has its quartz optical axis at a different angle from that of assembly 100. Thus, the quartz optic axis is rotated or tilted about the z-axis. This new assembly may be moved into place in response to a signal from the LCU 15 to a motor 350 or solenoid connected to the PLZT modulator assembly. Such signal from the LCU may be in response to sensing of either a 600 dpi scanner or a 600 × 600 dpi$^2$ resolution font library cartridge with a suitable cartridge sensor sensing a coded structure such as a notch or tab on the cartridge or the resolution code may be encoded in the data on the recording media and signaled to the LCU. In response to sensing of a required printing in the 600 × 600 dpi$^2$ resolution, the appropriate PLZT modulator is rotated to an appropriate angle for shifting the pixels an angle $\phi$, as shown in FIG. 8. In the example of a 300 dpi LED printhead printing a 600 × 600 dpi$^2$ resolution, the components of the beam shifter are fabricated such that the optical axis of the quartz and the axis of the linear polarizer are at 27° to the cross-track axis and the PLZT electrodes are at 72° (45° and 27°) to the cross-track axis. This is analogous to rotating the assembly shown in FIG. 6 by 27° around the z-axis. The shifted pixels are shown in FIG. 8 with dashed arrows indicating the positions of the recorded shifted pixels. LEDs that are selected to record pixels are enabled at every 1/1200" recording intervals of web movement. In the recording interval for recording pixel line period N, pixel J is say recorded by LED I during line period N, pixel K is a shifted pixel recorded by LED 1 during line period N+1 but shifted into line N, pixel L is recorded by LED 2 during line period N and pixel M is recorded by LED 2 during line period N+1 but shifted into line N. As noted above, the amount of beam shifting is a function of quartz thickness. It is contemplated that one assembly 100 may be provided with a quartz thickness such as to be optimized for the 600 × 600 dpi$^2$ resolution case and used for also recording the 300 × 600 dpi$^2$ resolution pixels where the pixels are shifted laterally slightly more than indicated in FIG. 4. A resolution of 300 × 300 dpi$^2$ is also available without shifting and without use of the multiple address mode. Thus, such an assembly need only have its quartz axis rotated to the proper orientation or angle for the particular resolution recording operation.

Although the invention has been described with reference to one type of electro-optic modulator or birefringent material, other types may be used in accordance with the teachings herein. For example, one could substitute a liquid crystal display in place of the PLZT, however, such displays have a substantially slower response period.

The invention has been described in detail with particular reference to preferred embodiments thereof and illustrative examples, but it will be understood that variations and modifications can be effected within the spirit and scope of the invention.

What is claimed is:

1. A recording apparatus comprising:

a light sensitive recording medium;

means for moving said recording medium in a first direction relative to a row of individually energizable light-emitting recording elements, said first direction being transverse to said row;

a dot matrix printer including a plurality of said individually energizable light-emitting recording elements arranged in said row and generally uniformly spaced at a density of N recording elements per inch;

means for energizing selected ones of said recording elements for generating exposure causing light emissions during each of consecutive in time line recording time periods;

a beam shifter assembly means located within an optical path between said recording medium and said recording elements for shifting light from the selected recording elements, said beam shifter assembly means being operable in a first mode with passing of the light from the the selected recording elements without substantial lateral shifting of the light for exposure of said recording medium to record pixels with the light emitted during one of said line recording time periods and in a second mode with substantial positional shifting of the light in at least a lateral direction having a directional component parallel to the row of recording elements for exposure of said recording medium to record pixels with the light emitted during a second of said line recording time periods that is consecutive in time to said one of said line recording time periods, said beam shifter assembly means including means for polarizing the light from the recording elements to generate beams of polarized light and electro-optic modulator means for allowing said polarized light from the recording elements to pass through said electro-optic modulator means undeviated in said first mode and to divert said polarized light in said second mode for positional shifting in said lateral direction;

control means for controlling said beam shifter assembly means to enable operation of said beam shifter assembly means in said first mode and said second mode on alternating line recording time periods of exposure to increase recording resolution of said dot matrix printer; and wherein the beam shifter assembly means shifts beams energized during some alternate ones of the line recording time periods into pixel rows recorded during other ones of the line recording time periods to provide M recorded pixels per inch in a second direction transverse to said first direction wherein M>N.

2. The apparatus of claim 1 and wherein said control means is responsive to a signal related to a resolution of image data from a scanner.

3. The apparatus of claim 1 and wherein said control means is responsive to a signal related to a resolution of a font from a character font library.

4. The apparatus of claim 1 wherein the recording elements are light-emitting diodes.

5. The apparatus of claim 4 and wherein the electro-optic modulator means includes a PLZT material and said control means includes means for applying a time-changing electric field to the PLZT material to control operation of said beam shifter assembly means in said first mode and said second mode.

6. The apparatus of claim 5 and including a gradient index lens array located in the optical path between the electro-optical modulator means and the recording medium.

7. The apparatus of claim 6 and wherein the electro-optic modulator means is oriented to shift light in said second mode so that during said second line recording time period pixels are recorded on said recording medium in a same row as pixels recorded during said one of said line recording time periods wherein pixels are recorded by said modulator means operating in said first mode.

8. The apparatus of claim 1 and wherein the beam shifter assembly means comprises in combination a linear polarizer, a PLZT modulator and a quartz layer.

9. A recording apparatus comprising:

a light sensitive recording medium;

means for moving said recording medium in a first direction relative to a row of individually energizable light-emitting recording elements, said first direction being transverse to said row;

a dot matrix printer including a plurality of said individually energizable light-emitting recording elements arranged in said row and generally uniformly spaced at a density of N recording elements per inch;

means for energizing selected ones of said recording elements for generating exposure causing light emissions during each of consecutive in time line recording time periods;

a beam shifter assembly means located within an optical path between said recording medium and said recording elements for shifting light from the selected recording elements, said beam shifter assembly means being operable in a first mode with passing of the light from the selected recording elements without substantial lateral shifting of the light for exposure of said recording medium to record pixels with the light emitted during one of said line recording time periods and for operating in a second mode with the substantial positional shifting of light in at least a lateral direction having a directional component parallel to the row of recording elements for exposure of said recording medium to record pixels with light emitted during a second of said line recording time periods that is consecutive in time to said one of said line recording time periods, said beam shifter assembly means including a linear polarizer means for polarizing light from the recording elements to generate beams of polarized light and electro-optic modulator means, including a PLZT modulator and a quartz layer having an optical axis oriented relative to the row of recording elements, for allowing said polarized light from the recording elements to pass through said electro-optic modulator means undeviated in said first mode and to divert said polarized light in said second mode for positional shifting in said lateral direction, said beam shifter assembly means shifting pixels recorded during one of said line recording time periods into a pixel row recorded during a different one of said line recording time periods; and control means for controlling said beam shifter assembly means to enable operation of said beam shifter assembly means in said first mode and said second mode on alternating ones of the line recording time periods of exposure to increase recording resolution of said dot matrix printer.

* * * * *